US006746109B2

(12) United States Patent
Samuels

(10) Patent No.: US 6,746,109 B2
(45) Date of Patent: Jun. 8, 2004

(54) QUICK-COLOR CHANGE INK PUMPING SYSTEM

(75) Inventor: Gary B. Samuels, Tenafly, NJ (US)

(73) Assignee: GBS Marketing, Inc., Tenafly, NJ (US)

( * ) Notice: Subject to any disclaimer, the term of this patent is extended or adjusted under 35 U.S.C. 154(b) by 0 days.

(21) Appl. No.: 10/345,512

(22) Filed: Jan. 16, 2003

(65) Prior Publication Data

US 2003/0132994 A1 Jul. 17, 2003

Related U.S. Application Data

(60) Provisional application No. 60/349,152, filed on Jan. 16, 2002.

(51) Int. Cl.[7] ..... B41J 2/175
(52) U.S. Cl. ..... 347/85; 347/7
(58) Field of Search ..... 347/7, 84, 85, 347/86; 101/210, 364

(56) References Cited

U.S. PATENT DOCUMENTS 3,608,486 A * 9/1971 McDonald et al. ..... 101/365
4,651,897 A 3/1987 Johnson
4,792,292 A 12/1988 Gaenzle
4,921,132 A 5/1990 Wales et al.
5,168,807 A 12/1992 Elia et al.
5,170,710 A 12/1992 Harpold et al.
5,275,100 A 1/1994 Harpold et al.
5,341,737 A * 8/1994 Marozzi et al. ..... 101/216
5,427,136 A 6/1995 Weishew
5,653,915 A * 8/1997 Pardikes ..... 516/67
5,967,044 A 10/1999 Marschke

OTHER PUBLICATIONS

Technotrans manufacturer's literature concerning ink.supply sheet fed; Place of Publication: United States; Date of Publication: Sep. 2000.

* cited by examiner

*Primary Examiner*—Anh T. N. Vo
(74) *Attorney, Agent, or Firm*—Hoffmann & Baron, LLP

(57) ABSTRACT

A portable ink pumping system for supplying ink to an ink fountain includes a cart, a container, a progressive cavity pump, and an ink fountain mounting bar. The ink fountain mounting bar is designed to be releasably connected to the ink fountain of a printing station. The ink fountain mounting bar includes a proximity sensor, a control box, and at least two ink dispensing nozzles. The proximity sensor monitors the level of the ink in the ink fountain while the control box controls the level of the ink. The material of the nozzles and associated fittings and tubing allows for quick and thorough cleaning of any remaining ink when an ink change is required. Moreover, when a radical ink color change is required, the nozzles, fittings, and tubing can be removed and replaced with new components.

10 Claims, 5 Drawing Sheets

QUICK-COLOR CHANGE INK PUMPING SYSTEM

This application claims priority to U.S. Provisional Application No. 60/349,152 filed on Jan. 16, 2002, which is incorporated herein by reference.

BACKGROUND OF THE INVENTION

1. Field of the Invention

The present invention relates generally to ink pumping systems for large-scale color printing presses, and more particular to a portable ink pumping system that is easily and quickly disassembled and cleaned so that changes in inks and varnishes can be readily accommodated. In particular, the present invention relates to a portable ink pumping system for supplying ink to a standard ink fountain of a printing press system.

2. Brief Description of the Prior Art

FIG. 1 is a schematic diagram illustrating a conventional large-scale color printing press system 100. In the conventional system 100, paper 102, wound on a large roll 104, is fed through a series of printing stations 106 before exiting at a finishing station 108, where the paper may be cut and/or folded. Each printing station 106 is set up to apply a designated color ink to the front and/or back side of the paper 102. Each printing station 106 includes an upper ink fountain 110, which contains ink to be applied to the top surface of the paper 102, and a lower ink fountain 112, which contains ink to be applied to the bottom surface of the paper. Ink to the upper and lower ink fountains 110 and 112 of the printing stations 106 is supplied via an arrangement of high pressure pipes 114*a–d* connected between the printing stations 106 and an ink supply station 116.

The ink supply station 116 typically includes four (4) separate drums or barrels 118*a–d* respectively containing red, blue, yellow and black ink, known in the trade as process inks. The colors red, blue, yellow, black and combinations thereof encompass the vast majority of color printing applications. The drums 118*a–d* typically contain 3,000–5,000 gallons of ink and are respectively connected to the ink feed pipes 114*a–d* through a dedicated heavy-duty piston-style pump 120*a–d* for supplying ink from the drums to the printing stations 106. The pumps 120*a–d* are permanently dedicated to pumping only one particular color ink supplied by their respective drums 118*a–d*. In other words, once a particular color ink is pumped through a pump and associated feed pipes, it is virtually impossible to change over to a different colored ink without having remnants of the prior ink contaminate the new ink. This is due in part to the difficulty of disassembling and thoroughly cleaning of traditional heavy-duty piston-style ink pumps and pipes.

Each printing station 106 includes a manifold 122 in fluid communication with each of the ink feed pipes 114*a*–114*d*. The manifold 122 includes quick-connect fittings that allows for selection of a particular colored ink to be fed to the ink fountains 110 and 112. Each ink fountain 110 and 112 includes an ink level control system (not shown), which continuously monitors the level of ink in the fountain and sends signals to its respective pump 120*a–d* to supply additional ink when needed. Unlike the ink supply station 116, the ink fountains 110 and 112 can be relatively easily cleaned to allow for filling of a different colored ink. This is important in that different printing jobs require different sequences in the application of ink colors.

However, because the ink level control system contains hard piping, it is not easily cleaned and each ink level control system is typically permanently dedicated to a particular ink. Thus, when changing inks in an ink fountain, it is necessary to also change the ink level control system.

While the process inks, i.e., red, blue, yellow and black, are typically sufficient for the majority of printing applications, it is often necessary or desired to apply a different ink at one or more of the printing stations. For example, with some specialty papers it is occasionally necessary to use a process ink having an alternative chemical formulation. Additionally, some printing applications require one or more non-process inks or specialty inks, as known in the trade. Such specialty inks include those colors that cannot be achieved by mixing the primary process colors, or those inks which include some type of distinctive feature that cannot be achieved by the primary process inks. Some examples of specialty inks include fluorescent inks, metallic inks, inks containing glitter, etc.

When it is desired to use something other than the standard process inks at one of the printing stations 106, it is necessary to clean the upper and/or lower ink fountain and to supply the fountain with the new ink. Depending on the volume of the printing application, such specialty inks are typically supplied in 3–55 gallon containers. Due in part to the extremely high viscosity of printing inks, even with the smallest 3 gallon container, an operator must manually scoop ink from the container and deposit the ink into the ink fountain. This procedure is obviously messy, wasteful and very labor intensive, particularly in larger volume applications requiring 50 or more gallons of ink.

Accordingly, it would be desirable to provide a portable system that can be moved between print stations for supplying non-standard or specialty inks to a desired ink fountain. Additionally, it would be desirable to provide such a system that can be easily disassembled and thoroughly cleaned and/or replaced to allow for rapid changing from one ink color to another, so that only one portable ink pumping system is required for one or more printing presses.

SUMMARY OF THE INVENTION

The present invention is a portable ink pumping system for supplying ink to a standard ink fountain of a printing station which generally includes a container, a progressive cavity pump, and an ink fountain mounting bar. Preferably the portable ink pumping system includes a cart made of a rigid frame construction for supporting the container and the progressive cavity pump in a vertical upright orientation, as well as the ink fountain mounting bar when not in use.

The container holds the ink and is an interchangeable component of the system. The container includes an opening through which a shaft of the pump is inserted for pumping ink from the container. A progressive cavity pump is utilized in the present invention due to the pump's ability to be easily disassembled and thoroughly cleaned, allowing for quick change-over to a different ink.

The ink fountain mounting bar is designed to be releasably connected to a standard ink fountain of a printing station. The ink fountain mounting bar includes at least two ink dispensing nozzles which are preferably connected via flexible tubing to a mounting bar ink coupler. A suitable length flexible hose preferably connects the outlet of the pump to the mounting bar ink coupler of the ink fountain mounting bar to supply ink from the pump to the nozzles. The material of the nozzles, fittings, tubing and the hose allows for quick and thorough cleaning of any remaining ink within the conduits when an ink change is required. Moreover, when a radical ink color change is required, the nozzles, fittings, tubing and hose can be removed and replaced with new components. Thus, only one ink fountain mounting bar is required with the present invention, as opposed to multiple specific ink dedicated level control systems as typically required.

The ink fountain mounting bar also includes a proximity sensor for monitoring the level of ink within the standard ink fountain, and a control box for controlling the level of ink in the standard ink fountain. The control box also provides an operator interface to the pumping system. When the control box receives a signal from the proximity sensor associated with the ink level falling below a first predetermined value, the control box in turn sends a signal to the motor of the pump to activate the motor to supply additional ink to the ink nozzles of the mounting bar. The proximity sensor further deactivates the motor of the pump when the ink has reached a second predetermined value. The control box can be switched between automatic operation of the system, via the proximity sensor, and manual operation of the electric motor of the pump.

The advantage of the present invention is that after pumping one color ink, the pumping system can be easily disassembled and cleaned before changing over to a different ink. The working components of the pump, as well as the hose, the piping and the nozzles of the mounting bar, are easily separately cleaned with an ink cleaning solvent, or press wash, as known in the industry. Once all of the components are thoroughly cleaned or replaced, the system is reassembled, a new ink container is positioned on the cart and the system can be quickly moved to a new location.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE PREFERRED EMBODIMENTS

Figure 2:
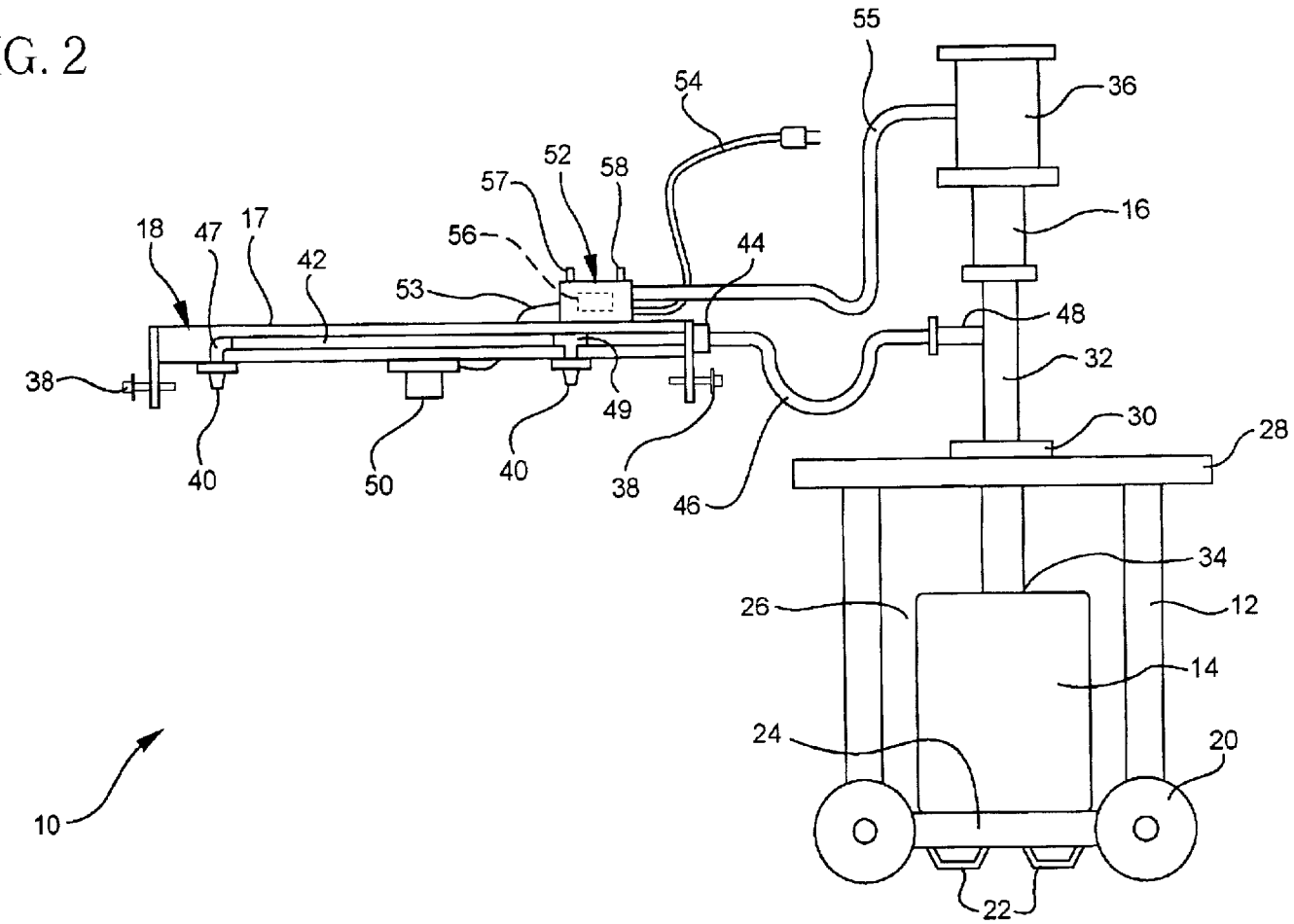
FIG. 2 is a side elevational view of the portable ink pumping system shown in conjunction with a cart.

Referring now to FIG. 2, a portable ink pumping system 10 formed in accordance with the present invention is shown. The portable ink pumping system 10 generally includes an ink container 14, a progressive cavity pump 16 and an ink fountain mounting bar 18.

Preferably the portable ink pumping system 10 also includes a cart 12 having a rigid frame construction capable of supporting the weight of a 50 gallon ink container 14 as well as the pump 16. The cart further preferably includes wheels 20, to allow the ink pumping system 10 to be rolled to a printing station, and/or fork channels 22 sized to receive forks of a forklift truck to allow the system to be lifted and moved by a forklift truck to a printing station as required. The cart 12 is generally rectangular having a base 24, an open interior space 26 and a top plate 28. The ink container 14 is supported on the base 24 within the interior space 26 of the cart 12. The top plate 28 includes an annular bushing 30 for receiving the shaft 32 of the progressive cavity pump 16 to support the pump in a vertical upright orientation.

Figure 3:
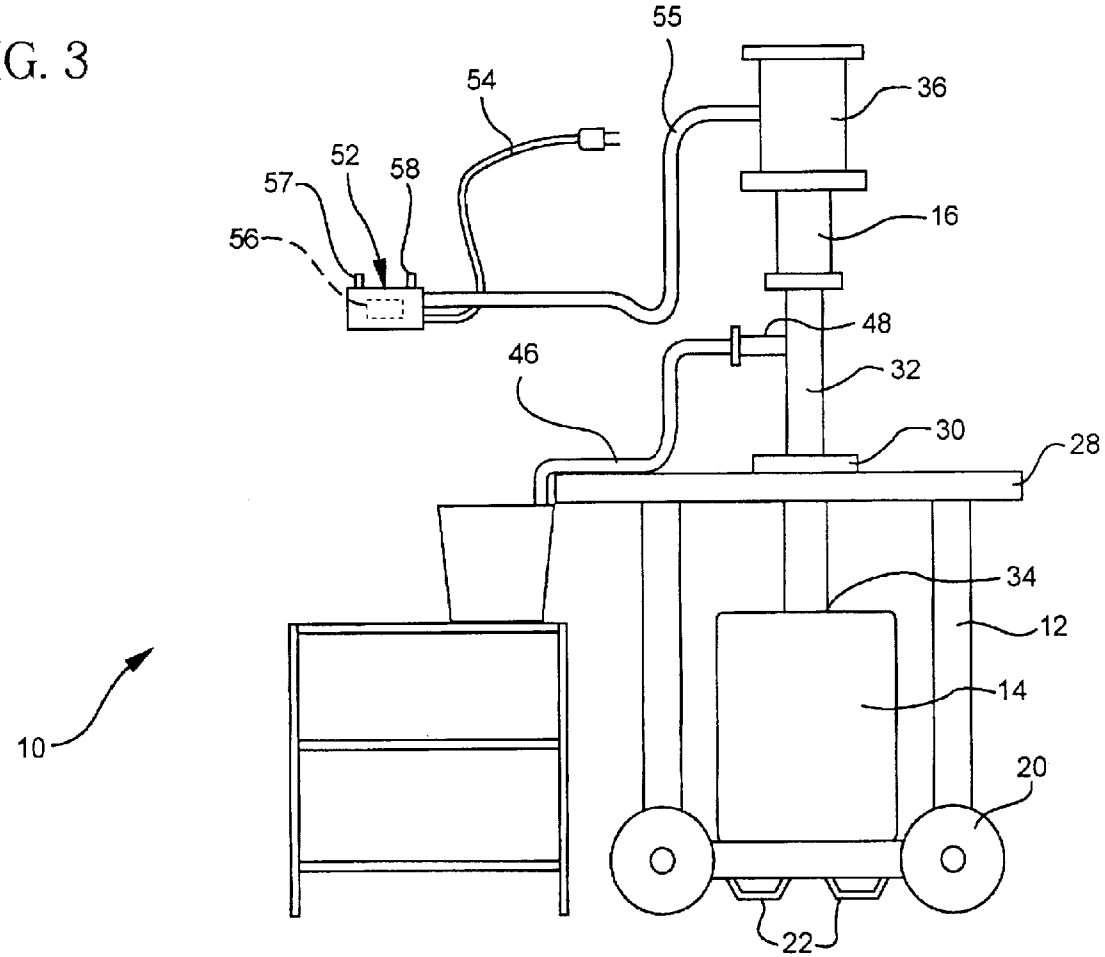
FIG. 3 is a side elevational view of the portable ink pumping system without the ink fountain mounting bar.
Figure 4:
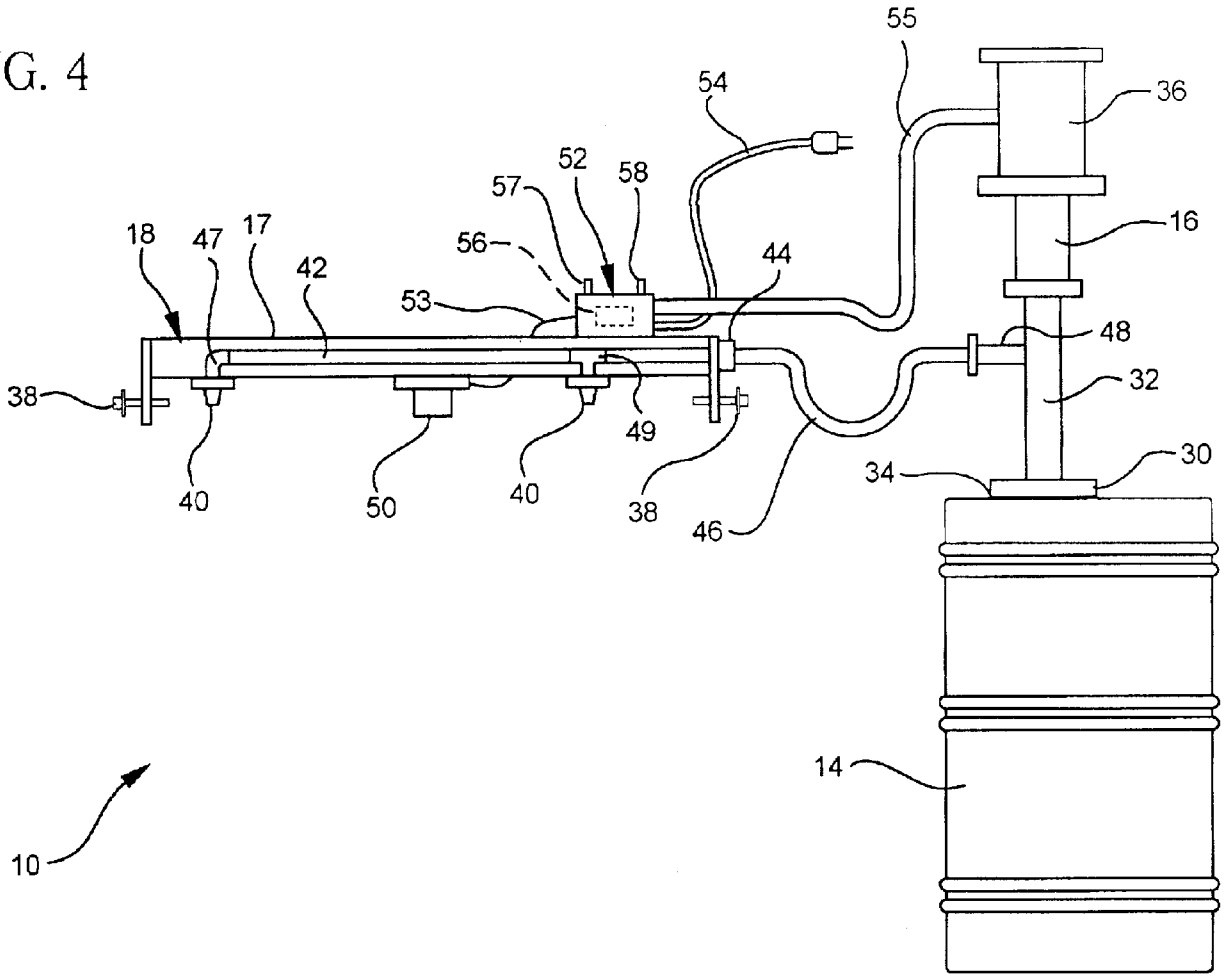
FIG. 4 is a drawing showing the side view of the portable ink pumping system where the container is a large drum.

The ink container 14 is an interchangeable component of the system 10, depending upon the amount of ink required to be pumped. Preferably, the interior space 26 of the cart 12 is sized to receive ink containers ranging from 5–50 gallons. Of course, for larger ink containers, the system can be used without the cart 12, as shown in FIG. 3. In such situations, the shaft 32 of the pump 16 is simply inserted into the opening 34 of the larger sized ink drum 14. In either event, all ink containers 14 include an opening 34 through which the shaft 32 of the pump 16 is inserted for pumping ink from the container 14.

Referring again to FIG. 2, the pump 16 is a conventional positive displacement pump that utilizes the progressive cavity design. The pump 16 typically includes a motor 36 for driving a rotor/impeller and stator (not shown) contained within the pump shaft 32. An air-driven progressive cavity pump, however, can also be used with the present invention. As the stator rotates, ink is drawn up through progressive cavities within the pump shaft 32 to exit the pump shaft 32 at an outlet 48. One such suitable pump is manufactured by Lutz Pumps, Inc. of Norcross, Ga. under Model No. B70V-SR with a B28 or B36 motor, also manufactured by Lutz. Due to the extremely high viscosity of printing inks, however, it may be necessary to upgrade the rotors and stator of the pump to change the pump from a standard 12:1 ratio to a more preferable 25:1 ratio. Preferably, the standard rubber seals provided with the pump are changed to ceramic/Viton™ seals to ensure that the ink cleaning solvents used to clean the pump do not disintegrate the seals.

Previously it was unknown in the art to use such a progressive cavity pump in a portable ink pumping system. The progressive cavity pump is desirable in such a situation due to the pump's ability to be easily disassembled and thoroughly cleaned. In particular, the construction of the elements within the pump shaft allows for rapid disassembly and separate cleaning of the components. Additionally, the internal shaft components are typically made from materials such as Teflon™, which can be thoroughly and completely cleaned using an ink cleaning solvent without damaging the components.

Figure 5:
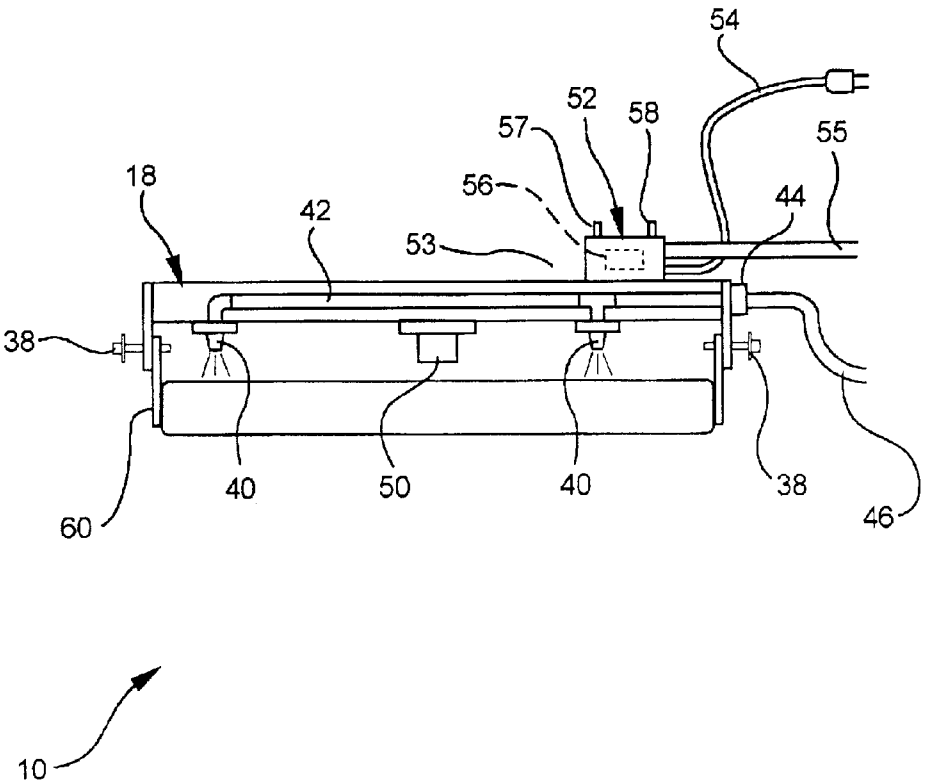
FIG. 5 is a partial side elevational view of the ink fountain mounting bar showing the mounting bar attached to a schematic representation of an ink fountain while ink is flowing from the dispensing nozzles.

Referring to FIGS. 2 and 5, the ink fountain mounting bar 18 is generally a rigid bar 17 sized to be releasably connected to a standard ink fountain 60 of a printing station. The ink fountain mounting bar 18 of the present invention is similar to the multiple ink level monitoring devices typically provided by the manufacturer of a conventional printing press. However, the ink mounting bar 18 of the present invention is dedicated to the portable ink pumping system 10 and is designed to travel with the cart 12 and to be releasably connected to the ink fountain 60 of a printing station. In this regard, the ink fountain mounting bar 18 includes quick-release pins 38, such as ball-lock pins, as shown in FIG. 5, which are sized to be releasably inserted into mounting holes adjacent the ink fountain 60 of a printing station. Additionally, the cart 12 is preferably designed to stow the mounting bar 18 when not in use. As shown in FIG. 3, there may be situations where the pump 16 is utilized without the ink fountain mounting bar 18 during maintenance, set-up or when pumping ink to a non-standard ink fountain. In these situations, the mounting bar 18 can be stowed on the cart 12 and the system can be set-up to pump without the bar 18.

Referring to FIG. 2, the ink fountain mounting bar 18 includes at least two ink dispensing nozzles 40 which are connected via tubing 42 to a mounting bar ink coupler 44. A suitable length flexible hose 46 connects the outlet 48 of the pump 16 to the ink coupler 44 of the ink fountain mounting bar 18. Thus, ink pumped from the container 14 by the pump 16 travels through the flexible hose 46 into the tubing 42 of the ink fountain mounting bar 18 and exits the nozzles 40 into the ink fountain 60 of the printing press as shown in FIG. 5. The hose 46 is preferably made from a suitably flexible braided reinforced polyester tubing, which allows see-through flow. A suitable hose for use with the Lutz pump described above is a ¾" diameter Rollerflex BT™ hose supplied by Metropolitan Rubber Co., Inc. of Hackensack, N.J. under Model No. BTC-0340. Tubing 42 preferably includes a polyvinylchloride (PVC) or nylon elbow fitting 47, T-fitting 49, and hose clamps as required, to secure the tubing to the mounting bar 18 and to ensure fluid connection between the nozzles 40 and the fluid coupler 44. Again, the materials of the components of the tubing 42 and the hose 46 allows for quick and thorough cleaning of any remaining ink within the conduits when an ink change is required. Additionally, because the conduit components are relatively inexpensive, they can be replaced with new components if required.

The ink fountain mounting bar 18 further preferably includes a proximity sensor 50. The proximity sensor 50 continuously monitors the level of ink within the fountain 60 when the mounting bar 18 is mounted to the ink fountain 60 of the printing station. A suitable proximity sensor is Model No. E2K-C25MY2 manufactured by Omron Corp. The proximity sensor 50 is mounted on the mounting bar 18 to point in the same direction as the ink supply nozzles 40 and is electrically connected to a control box 52 via electrical wiring 53 for sending signals to the control box 52 when the ink in the ink fountain 60 is below a first predetermined value (level).

The control box 52 is also provided on the ink fountain mounting bar 18 and is further electrically connected to the motor 36 of the pump 16 via electrical wiring 55. When the control box 52 receives a signal from the proximity sensor 50, it in turn sends a signal to the motor 36 of the pump 16 to activate the motor to supply additional ink to the ink nozzles 40 of the mounting bar 18. The control box 52 includes its own power supply cord 54, which can be electrically connected to a standard electrical outlet box adjacent an ink fountain being filled. The control box 52 in turn supplies power to the proximity sensor 50 and the motor 36 of the pump 16. The control box can further be provided with suitable electrical relays 56, switches 57 and LED displays 58 to provide an operator interface to the system 10. For example, the control box 52 can be provided with a switch 57 that allows for automatic operation of the system 10 via the proximity sensor 50 or manual operation of the electric motor 36 of the pump 16.

In operation, when a non-standard ink, e.g., a specialty ink, is required in one of the ink fountains of a printing press, any remaining process ink in the ink fountain is first removed and the ink fountain is thoroughly cleaned. The ink pumping system 10 of the present invention is then moved to the ink fountain and the ink fountain mounting bar 18 is secured to the mounting flanges of the ink fountain. Once the desired ink container 14 is positioned within the interior space 26 of the cart 12, and the shaft 32 of the pump 16 is inserted within the container, the electrical supply cord 54 of the control box 52 is electrically connected to a nearby electrical outlet. The system 10 is then activated by the switch 57 of the control box 52 to begin supplying ink through the nozzles 40 of the mounting bar 18 into the ink fountain 60. The proximity sensor 50 of the mounting bar 18 continuously monitors the level of ink within the fountain 60 and deactivates the motor 36 of the pump 16 when the ink has reached a second predetermined value (level). Once the ink fountain 60 is completely full, the mounting bar 18 remains in place on the ink fountain to continuously supply additional ink to the fountain 60 during the printing run if needed. When the printing run is complete, the mounting bar 18 is simply removed from the ink fountain 60 by disconnecting the releasable pins 38 and the bar 18 is stowed on the cart 12. The cart 12 can then be rolled, or otherwise moved, to another printing station.

It is conceivable that within a printing facility there can be numerous ink pumping systems 10, each dedicated, for example, to a specific specialty ink. However, the advantage of the present invention is that after pumping one specialty ink, the pumping system 10 of the present invention can be easily disassembled and cleaned before changing over to a different ink. The hose 46 and the electrical connections of the pump 16 are simply disconnected and the pump 16 withdrawn from the ink container 14. The working components, i.e., the rotator/impeller, stator, baffle and packing of the pump shaft 32 are disassembled and separately cleaned with an ink cleaning solvent. The hose 46, the piping 42 and the nozzles 40 of the mounting bar 18 are similarly drained and flushed of all remaining ink or are replaced. Once all components are thoroughly cleaned, the pump 16 is reassembled and all fluid and electrical connections between the pump 16 and the mounting bar 18 are re-established. A new ink container 14 is positioned within the interior space 26 of the cart 12 and the pump shaft 32 is reinserted into the container. Thus, the system 10 can be quickly and easily changed to pump a different specialty ink and can be quickly moved to a new location.

Figure 1:
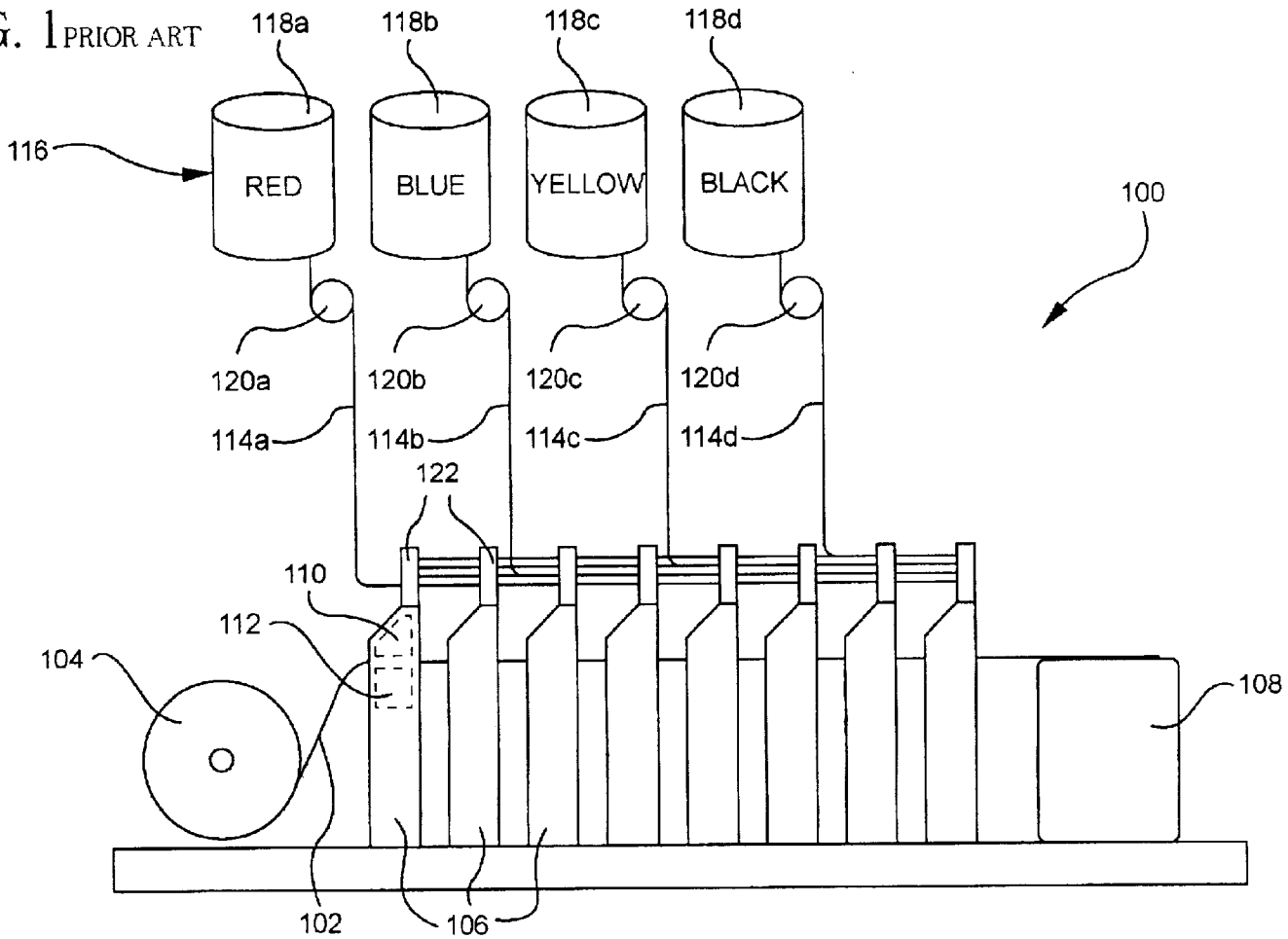
FIG. 1 PRIOR ART
FIG. 1 is a schematic diagram of a conventional color printing press system of the prior art.

The system of the present invention is equally well suited for pumping inks to conventional sheet-fed printing presses. Conventional sheet-fed printing presses are usually used for specialty printing applications and, due to the lower volume, typically are not connected to a sophisticated process ink supply station, as shown in FIG. 1. Thus, conventional sheet-fed presses are typically supplied with ink by the manual scooping process. Furthermore, some printing facilities simply do not have the capital required to install a sophisticated process ink supply station. Here too, ink is typically supplied to the printing stations by the manual scooping process. Accordingly, the ink pumping system of the present invention can be utilized to not only supply specialty inks to sheet-fed printing presses, but can also be utilized to supply process inks. Thus, the present invention has the potential to take the place of sophisticated process ink supply stations.

As a result of the present invention, a portable ink pumping system that can be quickly and easily cleaned to allow for rapid change over between different inks is provided. The system is completely portable to allow for easy moving between ink printing stations so that it is conceivable that only one system is required in a printing facility. The system eliminates the messy, wasteful and time consuming prior art procedure of manually scooping ink from its container into the ink fountain. The result is a clean and efficient system for providing inks to an ink fountain of a printing press.

While there has been described what is presently believed to be the preferred embodiments of the invention, those skilled in the art will realize that various changes and modifications may be made to the invention without departing from the spirit of the invention, and it is intended to claim all such changes and modification as fall within the scope of the invention.

What is claimed is:

1. A portable ink pumping system for supplying ink to a standard ink fountain of a printing station, the ink having a level, said portable ink pumping system comprising:

a container having an opening for holding the ink;

a progressive cavity pump having an outlet and a motor for driving an impeller and stator located within a shaft, said shaft being inserted into said opening of said container for pumping the ink from said container to said outlet; and an ink fountain mounting bar including:

a rigid bar configured to be releasably attached to the standard ink fountain of the printing station;

at least two ink dispensing nozzles mounted to said rigid bar and being connected in fluid communication with said outlet for dispensing the ink into the standard ink fountain;

a proximity sensor for monitoring the level of the ink in the standard ink fountain; and a control box mounted to said rigid bar and being electrically connected to said motor and said proximity sensor for controlling the level of ink in the standard ink fountain.

2. A portable ink pumping system as defined by claim 1, further comprising a cart having an interior space for receiving said container.

3. A portable ink pumping system as defined by claim 2, wherein said cart includes wheels.

4. A portable ink pumping system as defined by claim 2, wherein said cart includes a pair of fork channels configured to cooperate with a forklift truck.

5. A portable ink pumping system as defined by claim 1, wherein said ink fountain mounting bar includes a pair of quick release pins configured to be releasably inserted into mounting holes adjacent to the standard ink fountain of the printing station.

6. A portable ink pumping system as defined by claim 1, further comprising a mounting bar ink coupler connected to said ink fountain mounting bar, said mounting bar ink coupler being connected by a hose to said outlet and by tubing to said ink dispensing nozzles to provide said fluid communication between said outlet and said ink dispensing nozzles.

7. A portable ink pumping system as defined by claim 1, wherein said proximity sensor is configured to send a signal to said control box when the level of the ink in the standard ink fountain falls below a first predetermined value.

8. A portable ink pumping system as defined by claim 7, wherein said control box is configured to activate said motor when receiving said signal corresponding to said first predetermined value.

9. A portable ink pumping system as defined by claim 1, wherein said proximity sensor is configured to send a signal to said control box when the level of the ink in the standard ink fountain is at a second predetermined value.

10. A portable ink pumping system as defined by claim 9, wherein said control box is configured to deactivate said motor when receiving said signal corresponding to said second predetermined value.

* * * * *